United States Patent [19]

Doner et al.

[11] Patent Number: 4,582,617

[45] Date of Patent: Apr. 15, 1986

[54] GREASE COMPOSITION CONTAINING BORATED EPOXIDE AND HYDROXY-CONTAINING SOAP GREASE THICKENER

[75] Inventors: John P. Doner, Sewell; Andrew G. Horodysky, Cherry Hill; John A. Keller, Jr., Pitman, all of N.J.

[73] Assignee: Mobil Oil Corporation, New York, N.Y.

[21] Appl. No.: 641,079

[22] Filed: Aug. 15, 1984

Related U.S. Application Data

[63] Continuation-in-part of Ser. No. 519,878, Aug. 3, 1983.

[51] Int. Cl.[4] ..... C10M 117/02; C10M 139/00; C10M 137/14

[52] U.S. Cl. ..... 252/32.7 E; 252/49.6; 252/52 A

[58] Field of Search ..... 252/49.6, 52 A, 32.7 E, 252/32.5

[56] References Cited

U.S. PATENT DOCUMENTS

| | | | |
|---|---|---|---|
| 3,625,899 | 12/1971 | Sawyer | 252/49.6 |
| 4,244,829 | 1/1981 | Coupland et al. | 252/49.6 |
| 4,370,248 | 1/1983 | Horodysky et al. | 252/49.6 |
| 4,410,438 | 10/1983 | Horodysky | 252/49.6 |

*Primary Examiner*—Jacqueline V. Howard

*Attorney, Agent, or Firm*—A. J. McKillop; M. G. Gilman; L. P. Hobbes

[57] ABSTRACT

Grease compositions, wherein the grease is thickened with a metal hydroxy-containing soap grease thickener are provided. Other essential ingredients of the compositions include borated hydrocarbyl epoxides and phosphorus and sulfur moieties.

25 Claims, No Drawings

GREASE COMPOSITION CONTAINING BORATED EPOXIDE AND HYDROXY-CONTAINING SOAP GREASE THICKENER

CROSS REFERENCE

This application is a continuation-in-part of copending application Ser. No. 519,878, filed Aug. 3, 1983.

BACKGROUND OF THE INVENTION

1. Field of the Invention

The invention is concerned with a novel group of compositions. It more particularly relates to a grease composition comprising oil, hydroxy-containing soap thickener and borated epoxide, optionally containing phosphorus and sulfur moities.

2. Discussion of the Prior Art

With respect to the novel compositions of this invention, no prior art is known that teaches or suggests them. However, one of the applicants herein filed applicaton Ser. No. 329,774 on Dec. 11, 1981, dealing with lubricant compositions, including greases, comprising borated epoxides in which boron is present in excess. Also, certain other forms of epoxides have been used in lubricants. For example, U.S. Pat. No. 4,244,829 describes the use of epoxidized fatty acid esters as lubricity agents in lubricating oils. U.S. Pat. No. 4,410,438 discloses lubricants containing borated epoxides. One of the lubricants is a grease and one of a host of thickeners is hydroxystearate.

SUMMARY OF THE INVENTION

In accordance with the invention, ther is provided an improved grease composition containing a major proportion of a grease and a minor amount of a compound prepared by reacting an epoxide of the formula

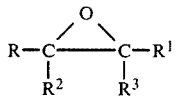

wherein R, $R^1$, $R^2$ and $R^3$ are hydrogen or a $C_1$ to $C_{30}$ hydrocarbyl group, at least one of which is hydrocarbyl, with a metaborate or other similar boron source, boric acid, boric oxide or an alkyl borate of the formula $$(R^4O)_xB(OH)_y$$

wherein x is 1 to 3, y is 0 to 2, their sum being 3, and $R^4$ is an alkyl group containing from 1 to 6 carbon atoms, the improvement comprising thickening said grease with a thickener containing at least about 15% by weight of a hydroxy-containing soap thickener. The presence of phosphorus and sulfur moieties provides an even higher dropping point.

Preferably the epoxide is overborated. By "overborated" is meant the presence in the borated product of more than a stoichiometric amount of boron.

DESCRIPTION OF SPECIFIC EMBODIMENTS

The borated epoxides of the invention can be made by reacting an epoxide with boron compound, such as boric oxide, boric acid or an alkyl borate, or mixtures thereof. The resulting products are primarily monoborate esters, but other possible products present are the products of reaction between epoxide dimers, or higher oligomers, and a boron compound to form the corresponding borate esters. Included within the scope of the epoxides as set forth above, are 1,2-epoxyoctane, 1,2-epoxydecane, 1,2-epoxydodecane, 1,2-epoxytetradecane, 1,2-epoxypentadecane, 1,2-epoxyhexadecane, 1,2-epoxyheptadecane, 1,2 -epoxyoctadecane, 1,2-epoxyeicosane and mixtures of such epoxides, as well as mixtures of other epoxides. These include epoxides of mixtures of $C_{22}$ to $C_{30}$ olefins and of mixtures of $C_{24}$ to $C_{28}$ olefins. Also included are epoxides from dimers of octene, dimers of decene, dimers of mixed octene and decene, epoxides from decene trimers, epoxides from propylene trimers and tetramers and butylene dimers, trimers and tetramers, and the like. Hydrocarbyl is meant to include alkyl, aryl, cycloalkyl or cycloalkenyl groups containing from 8 to 30 carbon atoms, preferably 10 to 22 carbon atoms. Preferably, hydrocarbyl is an alkyl group.

As noted hereinabove, the boron compound used is boric acid, boric oxide or an alkyl borate, preferably boric acid. The alkyl borates include the mono-, di- and trialkyl borates, such as the mono-, di- and triethyl borates.

The reaction to form the borate ester can be carried out at from about 80° C. to about 260° C., preferably from about 110° C. to about 180° C. The temperatures chosen will depend for the most part on the particular reactants and on whether or not a solvent is used. In carrying out this reaction, it is preferable that quantities of reactants be chosen such that the molar ratio of epoxide to boron compound be from about 0.2 to about 1, preferably from about 0.5 to about 0.9. The epoxide can be reacted with an excess of the borating species to form a borate ester containing from about 0.1% by weight of boron to as much as 10% or more of boron.

While atmospheric pressure is generally preferred, the reaction can be advantageously run at from about 1 to about 5 atmospheres. Furthermore, where conditions warrant it, a solvent may be used. In general, any relatively non-polar, unreactive solvent can be used, including benzene, toluene, xylene and 1,4-dioxane. Other hydrocarbon and alcoholic solvents, which include propanol, butanol and the like, can be used. Mixtures of alcoholic and hydrocarbon solvents can be used also.

The times for the reactions are not critical. Thus, any phase of the process can be carried out in from about 1 to about 20 hours.

A narrow class of thickening agents is preferred to make the grease of this invention. Included among the preferred thickening agents are those containing at least a portion of alkali metal, alkaline earth metal or amine soaps of hydroxyl-containing fatty acids, fatty glycerides and fatty esters having from 12 to about 30 carbon atoms per molecule. The metals are typified by sodium, lithium, calcium and barium. Preferred is lithium. Preferred members among these acids and fatty materials are 12-hydroxystearic acid and glycerides containing 12-hydroxystearates, 14-hydroxystearic acid, 16-hydroxystearic acid and 6-hydroxystearic acid.

The entire amount of thickener need not be derived from the aforementioned preferred members. Significant benefit can be attained using as little thereof as about 15% by weight of the total thickener. A complementary amount, i.e., up to about 85% by weight of a wide variety of thickening agents can be used in the grease of this invention. Included among the other useful thickening agents are alkali and alkaline earth metal soaps of methyl-12-hydroxystearate, diesters of a $C_4$ to $C_{12}$ dicarboxylic acid and tall oil fatty acids. Other alkali or alkaline earth metal fatty acids containing from 12 to 30 carbon atoms and no free hydroxyl may be used. These include soaps of stearic and oleic acids.

Other thickening agents include salt and salt-soap complexes as calcium stearate-acetate (U.S. Pat. No. 2,197,263), barium stearate acetate (U.S. Pat. No. 2,564,561), calcium, stearate-caprylate-acetate complexes (U.S. Pat. No. 2,999,065), calcium caprylate-acetate (U.S. Pat. No. 2,999,066), and calcium salts and soaps of low-, intermediate- and high-molecular weight acids and of nut oil acids.

Another group of thickening agents comprises substituted ureas, phthalocyamines, indanthrene, pigments such as perylimides, pyromellitdiimides, and ammeline, as well as certain hydrophobic clays. These thickening agents can be prepared from clays which are initially hydrophilic in character, but which have been converted into a hydrophobic condition by the introduction of long-chain hydrocaron radicals into the surface of the clay particles prior to their use as a component of a grease composition, as, for example, by being subjected to a preliminary treatment with an organic cationic surface active agent, such as an onium compound. Typical onium compounds are tetraalkylammonium chlorides, such as dimethyl dioctadecyl ammonium chloride, dimethyl dibenzyl ammonium chloride and mixtures thereof. This method of conversion, being well known to those skilled in the art, is believed to require no further discussion, and does not form a part of the present invention.

The third member(s) that may be present in the grease composition are the phosphorus and sulfur moieties. Both of these can be present in the same molecule, such as in a metal or non-metal phosphorodithioate of the formula

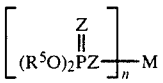

wherein $R^5$ is a hydrocarbyl group containing 3 to 18 carbon atoms, M is a metal or non-metal, n is the valence of M and Z is oxygen or sulfur, at least one of which is sulfur.

In this compound, $R^5$ is preferably an alkyl group and may be a propyl, butyl, pentyl, hexyl, octyl, decyl, dodecyl, tetradecyl or octadecyl group, including those derived from isopropanol, butanol, isobutanol, sec-butanol, 4-methyl-2-pentanol, 2-ethylhexanol, oleyl alcohol, and mixtures thereof. Further included are alkaryl groups such as butylphenyl, octylphenyl, nonylphenyl and dodecylphenyl groups.

The metals covered by M include those in Groups IA, IIA, IIB and VIII of the Periodic Table. Some that may be mentioned are lithium, sodium, calcium, zinc, cadmium, silver, molybdenum and gold. Non-metallic ions include organic groups derived from vinyl esters such as vinyl acetate, vinyl ethers such as butyl vinyl ether and epoxides such as propylene oxide and 1,2-epoxydodecane. Non-metallic ions also include nitrogenous compounds such as those derived from hydrocarbyl amines and diamines including oleylamines and N-oleyl-1,3-propylenediamine. Also included are imidazolines, oxazolines and the like.

The phosphorus and sulfur can also be supplied from the combination of two separate compounds, such as the combination of (1) a dihydrocarbyl phosphite having 2 to 10 carbon atoms in each hydrocarbyl group or mixtures of phosphites and (2) a sulfide such as sulfurized isobutylene, dibenzyl disulfide, sulfurized terpenes, phosphorodithionyl disulfide and sulfurized jojoba oil. The phosphites embrace the dibutyl, dihexyl, dioctyl, didecyl and similar phosphites. Phosphate esters containing 4 to 20 carbon atoms in each hydrocarbyl group, such as tributyl phosphate, tridecyl phosphate, tricresyl phosphate and mixtures of such phosphates, can also be used.

In summary, it is essential to the practice of this invention, in which greases having vastly improved dropping points are obtained, that at least the first two of the above-mentioned ingredients be formulated into the composition. Thus:

first, with respect to the preparation of the grease, the thickener will have at least about 15% by weight of a metal or non-metal hydroxy-containing soap therein, the total thickener being from about 3% to about 20% by weight of the grease composition;

second, there will be added to the grease from about 0.01% to about 10% by weight, preferably about 0.1% to about 2%, of a borated epoxide, in which the borated epoxide has been reacted with preferably at least an equimolar amount of a boron compound; and as a third component, the composition may have therein from 0.01% to about 10% by weight preferably, from 0.2% to 2% by weight of phosphorus- and sulfur-containing compounds or a mixture of two or more compounds which separately supply the phosphorus and sulfur moieties. If separate compounds are used, an amount of the mixture equivalent to the above concentration levels is used to supply desired amounts of phosphorus and sulfur.

It was noted that, when the hydroxy-containing thickener was used with the borated epoxide, the dropping point of the grease was consistently unexpectedly higher than with a grease from the same grease vehicle and the same borated epoxide, but with a different thickener, e.g., a non-hydroxy-containing thickener. Thus, the broad invention is to grease composition thickener with an OH-containing thickener, plus the borated epoxide.

In general, the reaction products of the present invention may be employed in any amount which is effective for imparting the desired degree of friction reduction, antiwear activity, antioxidant activity, high temperature stability or antirust activity. In many applications, however, the borated epoxide and the phosphorus- and/or sulfur-containing compound(s) are effectively employed in combined amounts from about 0.02% to about 20% by weight, and preferably from about 0.2% to about 4% of the total weight of the composition.

The greases of the present invention can be made from either a mineral oil or a synthetic oil, or mixtures thereof. In general, mineral oils, both paraffinic, naphthenic and mixtures thereof, may be of any suitable lubricating viscosity range, as for example, from about 45 SSU at 100° F. to about 6000 SSU at 100° F., and preferably from about 50 to about 250 SSU at 210° F. These oils may have viscosity indexes ranging to about 100 or higher. Viscosity indexes from about 70 to about 95 are preferred. The average molecular weights of these oils may range from about 250 to about 800. In making the grease, the lubricating oil from which it is prepared is generally employed in an amount sufficient to balance the total grease composition, after accounting for the desired quantity of the thickening agent, and other additive components to be included in the grease formulation.

In instances where synthetic oils are desired, in preference to mineral oils, various compounds of this type may be successfully utilized. Typical synthetic vehicles include polyisobutylene, polybutenes, hydrogenated polydecenes, polypropylene glycol, polyethylene glycol, trimethylol propane esters, neopentyl and pentaerythritol esters, di(2-ethylhexyl) sebacate, di(2-ethylhexyl) adipate, dibutyl phthalate, flourocarbons, silicate esters, silanes, esters of phosphorus-containing acids, liquid ureas, ferrocene derivatives, hydrogenated synthetic oils, chain-type polyphenyls, siloxanes and silicones (polysiloxanes), alkyl-substituted diphenyl ethers typified by a butyl-substituted bis(p-phenoxy phenyl) ether, phenoxy phenylethers.

The metallic soap grease compositions containing one or more of the boratd epoxides and, optionally, one or more of the sulfur and phosphorus combinations described herein provide advantages in increased dropping point, improved grease consistency properties, antirust characteristics and potential antifatigue, antiwear and antioxidant benefits unmavailable in any of the prior greases known to us. The grease of this invention is unique in that it can be preferably manufactured by the admixture of additive quantities of the alcohol borates to the fully formed soap grease after completion of saponification.

The following Examples will present illustrations of the invention. They are illustrative only, and are not meant to limit the invention.

EXAMPLE 1

Borated 1,2-Epoxyhexadecane

Approximately 1440 g of 1,2-epoxyhexadecane (obtained commercially from Union Carbide), 500 g of toluene and 500 g of boric acid were charged to a 5 liter glass reactor equipped with heater agitator and Dean-Stark tube with condenser. The contents were heated up to 144° C. with agitation until water evolution stopped. This took place over a period of about 10 hours. The solvent was removed by vacuum distillation at about 160° C., and the product was filtered at about 120° C. through diatomaceous earth to yield a clear amber fluid as an amber waxy fluid upon cooling.

EXAMPLE 2

A lithium hydroxystearate grease thickener was prepared by saponification of a mixture containing about 8% by weight of 12-hydroxystearic acid and 9% by weight of the glyceride thereof, with lithium hydroxide monohydrate (2.5%) in a mineral oil vehicle (about 76%) at about 177° C. and final pressure of about 110 psig in a closed contactor. All percentages were percentages by weight of the total weight of the thickener.

EXAMPLE 3A

The thickener of Example 2 was dehydrated in an open kettle and 1.4% by weight of a boron ester was added to the grease concentrate. The boron-containing epoxide was prepared as in Example 1.

EXAMPLE 3B

Moderate heat was applied to the grease of Example 3A and sufficient oil was added to reduce the thickener content to about 9.0% and consequently the boron additive content to 1%. The boron content of the resulting grease was approximately 0.04% by weight. After cooling to 99° C., antioxidant, antirust, extreme pressure and antiwear additives including 1.5% zinc dialkyl phosphorodithioate, the dialkyl group being derived from a mixture of $C_3$ secondary and $C_6$ primary alcohols, were incorporated in the grease.

EXAMPLE 4

Base grease thickened with the lithium soap of a 50/50(wt.) mixture of stearic and palmitic acids, which are non-hydroxy-containing thickeners.

EXAMPLE 5

50 wt. % of the base grease of Example 2 and 50 wt. % of the base grease of Example 4, producing a 50-50 mixture of hydroxy- and non-hydroxy-containing thickeners.

EXAMPLE 6

Base grease of Example 4 plus 2 wt. % of the borated epoxide of Example 1.

EXAMPLE 7

Base grease of Example 5 plus (a) 1% or (b) 2% of the Example 1 product.

The results obtained using the above greases in the AS TM D2265-78 grease dropping point test are shown in the following table.

TABLE 1

| Sample | | D2265 Dropping Point, °C. |
|---|---|---|
| Base Grease of Example 2 | Dehydrated grease thickener | 199 |
| Example 3a | Dehydrated grease thickener + 1.4 wt % borated epoxide of Example 1 | 257 |
| Example 3b | Dehydrated grease thickener of Example 2 + 1.0 wt. % borated epoxide of Example 1 + diluent mineral oil + normal additive package (containing amine antioxidant, phenolic antioxidant, metallic dithiophosphate, sulfur-containing metal deactivator and nitrogen-containing antirust additives) | 307 |
| Example 4 | | 209 |
| Example 5 | | 190 |

TABLE 1-continued

| Sample | | D2265 Dropping Point, °C. |
|---|---|---|
| Example 6 | | 207 |
| Example 7 (a) | | 214 |
| Example 7 (b) | | 226 |
| Fully formulated base grease of Example 2 | Dehydrated grease thickener + diluent mineral oil + normal additive package (containing amine antioxidant, phenolic antioxidant, metallic dithiophosphate, additive sulfur-containing metal deactivator and nitrogen-containing antirust additives) | 193 |

The dropping point of the dehydrated hydroxystearate thickener without borated epoxide was 199° C. Adding 1.4 wt.% of borated epoxide to the thickener increased the dropping point to 257° C. After the normal grease additive package containing dithiophosphate was added to produce a finished grease, the dropping point increased further to 307° C. The dropping point of an identical, fully formulated finished grease with metallic dithiophosphate but without the borated epoxide was 193° C.

We claim:

1. An improved grease composition comprising a major amount of a grease and from about 0.01% to about 10% by weight of a reaction product made by reacting an epoxide of the formula

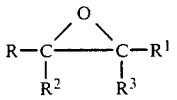

wherein R, $R^1$, $R^2$ and $R^3$ are hydrogen or a hydrocarbyl group containing from 1 to 30 carbon atoms at least 1 of which is hydrocarbyl, with a boron compound, the improvement comprising thickening said grease with a thickener containing at least about 15% by weight of a hydroxy-containing soap thickener.

2. The composition of claim 1 additionally containing from about 0.01% to about 10% by weight of a phosphorus and sulfur compound or a mixture of phosphorus-containing and sulfur-containing compounds to supply an equivalent amount of phosphorus and sulfur.

3. The composition of Claim 1 wherein the thickener is an alkali metal, alkaline earth metal or amine soap of a hydroxyl-containing fatty acid, fatty glyceride or fatty ester containing 12 to 30 carbon atoms.

4. The composition of claim 3 wherein the metal is sodium, lithium, calcium or barium.

5. The composition of claim 3 wherein the hydroxy-containing thickener is derived from 12-hydroxystearic acid, 14-hydroxystearic acid, 16-hydroxystearic acid, 6-hydroxystearic acid, the glyceride or ester thereof.

6. The composition of claim 1 wherein the epoxide is 1,2-epoxyoctane, 1,2-epoxydecane, 1,2-epoxydodecane, 1,2-epoxytetradecane, 1,2-epoxypentadecane, 1,2-epoxyhexadecane, 1,2-epoxyoctadecane, 1,2-epoxyeicosane, epoxides of mixtures of $C_{22}$ to $C_{30}$ olefins, epoxides of mixtures of $C_{24}$ to $C_{28}$ olefins, epoxides from decene trimers or epoxides from: dimers of octene; dimers of decene; or dimers of mixed octene and decene; trimers and tetramers of propylene; and dimers, trimers and tetramers of butylene.

7. The composition of claim 6 wherein the epoxide is 1,2-epoxyhexadecane.

8. The composition of claim 1 wherein the boron compound is boric acid.

9. The composition of claim 2 wherein the phosphorus and sulfur moieties are supplied by a phosphorothioate of the formula

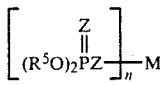

wherein $R^5$ is a hydrocarbyl group containing 3 to 18 carbon atoms, M is a metal or non-metal, n is the valence of M and Z is oxygen or sulfur, at least one of which is sulfur.

10. The composition of claim 9 wherein $R^5$ is an alkyl group or an alkaryl group.

11. The composition of claim 10 wherein $R^5$ is a propyl, butyl, pentyl, hexyl, octyl, dodecyl, tetradecyl, octadecyl, oleyl, butylphenol, octylphenyl, nonylphenyl or dodecylphenyl group or mixtures thereof.

12. The composition of claim 11 wherein $R^5$ is derived from isopropanol, butanol, isobutanol, sec-butanol, 4-methyl-2-pentanol, 2-ethylhexanol or mixtures thereof.

13. The composition of claim 9 wherein M is a metal from Group IA, IIA, IIB or VIII of the Periodic Table.

14. The composition of claim 13 wherein the metal is lithium, sodium, calcium, zinc, cadmium, molybdenum and gold.

15. The composition of claim 9 wherein M is derived from vinyl acetate, butyl vinyl ether, propylene oxide, 1,2-epoxydodecane, or a nitrogenous compound.

16. The composition of claim 2 wherein the phosphorus and sulfur moieties are supplied by a combination of (1) a dihydrocarbyl phosphite having 2 to 6 carbon atoms in each hydrocarbyl group, mixtures of such phosphites, or a phosphate ester having 4 to 20 carbon atoms in each hydrocarbyl group and (2) a sulfide selected from sulfurized isobutylene, dibenzyl disulfide, sulfurized terpenes, phosphorodithionyl disulfide and sulfurized jojoba oil.

17. The composition of claim 16 wherein the phosphite is a dibutyl, dihexyl, dioctyl or didecyl phosphite or mixtures thereof.

18. The composition of claim 16 wherein the phosphate ester is a tributyl, tridecyl or tricresyl phosphate or mixtures thereof.

19. The composition of claim 16 wherein the epoxide is 1,2-epoxyhexadecane, the boron compound is boric acid and the phosphorus- and sulfur-containing compound is zinc dialkyl phosphorodithioate wherein the alkyl group is derived from mixed $C_3$ secondary and $C_6$ primary alcohols.

20. The composition of claim 1 wherein the grease vehicle is a mineral oil.

21. The composition of claim 1 wherein the grease vehicle is a synthetic oil.

22. The composition of claim 1 wherein the grease vehicle is a mixture of mineral and synthetic oils.

23. A method of improving the dropping point of a grease composition comprising a major amount of a grease and from about 0.01% to about 10% by weight of a reaction product made by reacting an epoxide of the formula

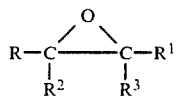

wherein R, $R^1$, $R^2$ and $R^3$ are hydrogen or a hydrocarbyl group containing from 1 to 30 carbon atoms at least 1 of which is hydrocarbyl, with a boron compound, said method comprising thickening said grease with a thickener containing at least about 15% by weight of a hydroxy-containing soap thickener.

24. The method of claim 23 in which the grease composition further contains from about 0.01% to about 10% by weight of a phosphorus and sulfur compound or a mixture of phosphorus-containing and sulfur-containing compounds to supply an equivalent amount of phosphorus and sulfur.

25. The composition of claim 1 wherein the boron compound is selected from metaborate, boric acid, boric oxide and an alkyl borate of the formula $$(R^4O)_xB(OH)_y$$

wherein x is 1 to 3, y is 0 to 2, their sum being 3, and $R^4$ is an alkyl group having 1 to 6 carbon atoms.

* * * * *